United States Patent [19]

Yokoi

[11] Patent Number: 4,732,502

[45] Date of Patent: Mar. 22, 1988

[54] PRINTER

[75] Inventor: Takeshi Yokoi, Kagamihara, Japan

[73] Assignee: Brother Kogyo Kabushiki Kaisha, Japan

[21] Appl. No.: 62,393

[22] Filed: Jun. 15, 1987

Related U.S. Application Data

[63] Continuation of Ser. No. 799,698, Nov. 19, 1985, abandoned.

[30] Foreign Application Priority Data

Nov. 19, 1984 [JP] Japan ..... 59-175234[U]
Nov. 20, 1984 [JP] Japan ..... 59-245475

[51] Int. Cl.[4] ..... B41J 29/02

[52] U.S. Cl. ..... 400/693; 400/692; 400/328

[58] Field of Search ..... 400/692–694, 400/320, 322, 328; 361/390–395

[56] References Cited

U.S. PATENT DOCUMENTS

| | | | |
|---|---|---|---|
| 4,296,454 | 10/1981 | Wong | 361/392 |
| 4,310,870 | 1/1982 | Kia et al. | 361/394 |
| 4,323,979 | 4/1982 | Johnston | 361/390 |
| 4,357,060 | 11/1982 | Kuhn | 400/692 |
| 4,372,694 | 2/1983 | Bevlo et al. | 400/88 |
| 4,452,542 | 6/1984 | Akazawa | 400/692 |
| 4,471,898 | 9/1984 | Parker | 361/394 |
| 4,507,102 | 3/1985 | Geis et al. | 400/320 |
| 4,527,285 | 7/1985 | Kekas et al. | 361/394 |
| 4,530,066 | 7/1985 | Ohwaki et al. | 361/391 |
| 4,549,825 | 10/1985 | Fish, III et al. | 400/692 |
| 4,586,838 | 5/1986 | Hara et al. | 400/320 |

*Primary Examiner*—William Pieprz
*Attorney, Agent, or Firm*—Jones, Tullar & Cooper

[57] ABSTRACT

A printing mechanism assembly, including a platen, a carriage bearing a print head thereon, a ribbon cassette, and drive mechanisms for driving these members for printing operation, is mounted on a subframe to form a unit. Also, control means including a printed board for controlling the operations of the drive mechanisms, and power supply means for supplying electric power to the drive mechanisms through the control means are unitized independently. All of the resulting units are mounted on a main frame. The subframe, with the printing mechanism assembly thereon, is removably mounted on the rear half portion of the main frame; the control unit on the underside of the main frame, and the power supply unit in a notch formed at the front corner portion of the main frame. Power supply units of various specifications may be used alternatively which incorporate different transformers adapted for varied external supply voltage connected thereto.

9 Claims, 10 Drawing Figures

PRINTER

This is a continuation of application Ser. No. 799,698, filed Nov. 19, 1985, and now abandoned.

BACKGROUND OF THE INVENTION

The present invention relates to a printer which has a platen for supporting a printing sheet and a carriage mounted with a print head adapted to move relatively to the platen for printing operation, and is adapted to be operated by electric power supplied from an external power source.

Printers of this type contain therein various complicated mechanisms and a number of components, such as a printing mechanism including a platen, carriage, etc., a control section for controlling the operation of the printing mechanism, a power supply section adapted to supply power from an external power source to the printing mechanism through the control section.

In assembling the printer, these mechanisms and components generally are mounted separately on, for example, the machine frame or chassis of the printer in succession. Thus, the assembly work is inefficient, and the mounting accuracy of the components is not high enough.

To cope with this, an improved method of assembly is proposed in which some of the mechanical components including the platen, print head, carriage, etc., are previously unitized, and the resultant unit structure is then mounted on the machine frame. However, this improvement cannot effect a satisfactory settlement yet, since the unitized components constitute only a very small part of the whole structure of the printer.

The aforesaid problems have an adverse influence on the efficiency of maintenance or inspection of various sections of the printer. For higher efficiency of the maintenance or inspection work, it is necessary that the mechanical sections be able to be each categorized as a single unit and be easy for operator access.

In the prior art printers, however, these points are not fully considered, and the mechanical sections have a sophisticated layout. Accordingly, it is hard to seize the arrangement of the individual mechanical sections, and the components or spots to be inspected may not be accessible unless a number of parts are disassembled or removed from the printer.

In connection with these problems, the power supply section generally is disposed inside the printer, e.g., in the rear portion of its inside space. Moreover, the power supply section is provided with a transformer, whereby power from an external high-voltage power source is converted into a necessary low-voltage power for the drive of the printer. When using the printer in a district of a different external supply voltage, however, it is necessary that the internally arranged power supply section be removed, or that the transformer be taken out of the casing of the power supply section to be replaced with an alternative one, inevitably requiring a rearrangement of wiring. Since the power supply section is located within the printer, its removal or the replacement of the transformer is very troublesome, necessitating an improvement.

SUMMARY OF THE INVENTION

The object of the present invention is to provide a printer, enjoying improved assembling efficiency and higher component mounting accuracy, and facilitating maintenance or inspection of various mechanical sections.

In order to achieve the above object, according to the present invention, there is provided a printer which comprises a printing mechanism assembly including a platen, a carriage having a print head facing the platen, and drive mechanisms for driving these members, a control means for controlling the printing operation of the printing mechanism assembly, and power supply means for supplying electric power from an external power source to the printing mechanism assembly through the control means, these means and assembly being each constructed as a single unit adapted to be mounted on a main frame.

In a preferred arrangement, the printing mechanism assembly is set on a subframe, which is mounted on the rear half portion of the main frame. Also, the control means is attached to the underside of the main frame, and the power supply means is removably mounted in a notch formed at the front corner portion of the main frame.

Thus, according to the present invention, the components of the printer are collected into relatively large units, so that the efficiency of assembly work is improved. In some cases, moreover, the components may be collectively removed from the main frame for efficient maintenance or inspection.

The printing mechanism assembly, control means, and power supply means are mounted on the upper side, underside, and front corner portion, respectively, of the main frame. Therefore, the individual units can be attached or detached without interfering with one another, and are easily accessible at the time of maintenance or inspection.

In the preferred embodiment, moreover, an opening is formed in that portion of the main frame to which a printed board of the control means is attached. Overlying the opening, a cover is removably mounted on the main frame.

Thus, the printed board of the control means can easily be accessed through the opening, from above the main frame, after removing the cover.

As for the power supply means, which is removably disposed at the front corner portion of the main frame, its maintenance and inspection, especially the replacement of the transformer, can be accomplished independently of the main body casing of the printer. Thus, a common printer may be used in compliance with different specifications if it is provided alternatively with various power supply units which individually include different transformers adapted for use in districts of varied external supply voltages.

In the preferred arrangement, furthermore, when the power supply unit casing is mounted on the main body casing, the outer peripheral surfaces of the unit casing become flush or continuous with those of the main body casing to form a rectangular outline of the printer. Thus, the attachment of the power supply means will not adversely affect the appearance of the external design of the printer.

In association with the above-mentioned arrangement, the present invention further provides a novel arrangement for grounding static electricity which may be produced between the platen and printing paper thereon.

BRIEF DESCRIPTION OF THE DRAWINGS

These and other objects and advantages of the present invention will be more completely described below with reference to the accompanying drawings, in which.

A printer according to an embodiment of the present invention will now be described in detail with reference to the accompanying drawings.

DETAILED DESCRIPTION OF THE PREFERRED EMBODIMENT

The illustrated printer is a dot printer adapted to be connected to a word processor in use, in which a print head reciprocates relatively to a platen for printing. In the description to follow, the head moving direction of the printer will be referred to as its longitudinal direction, and those sides of the printer remote from and nearer to the platen, as viewed along a direction normal to the longitudinal direction, will be referred to as the front and rear sides, respectively, of the printer.

Construction of Main Frame

Figure 1:
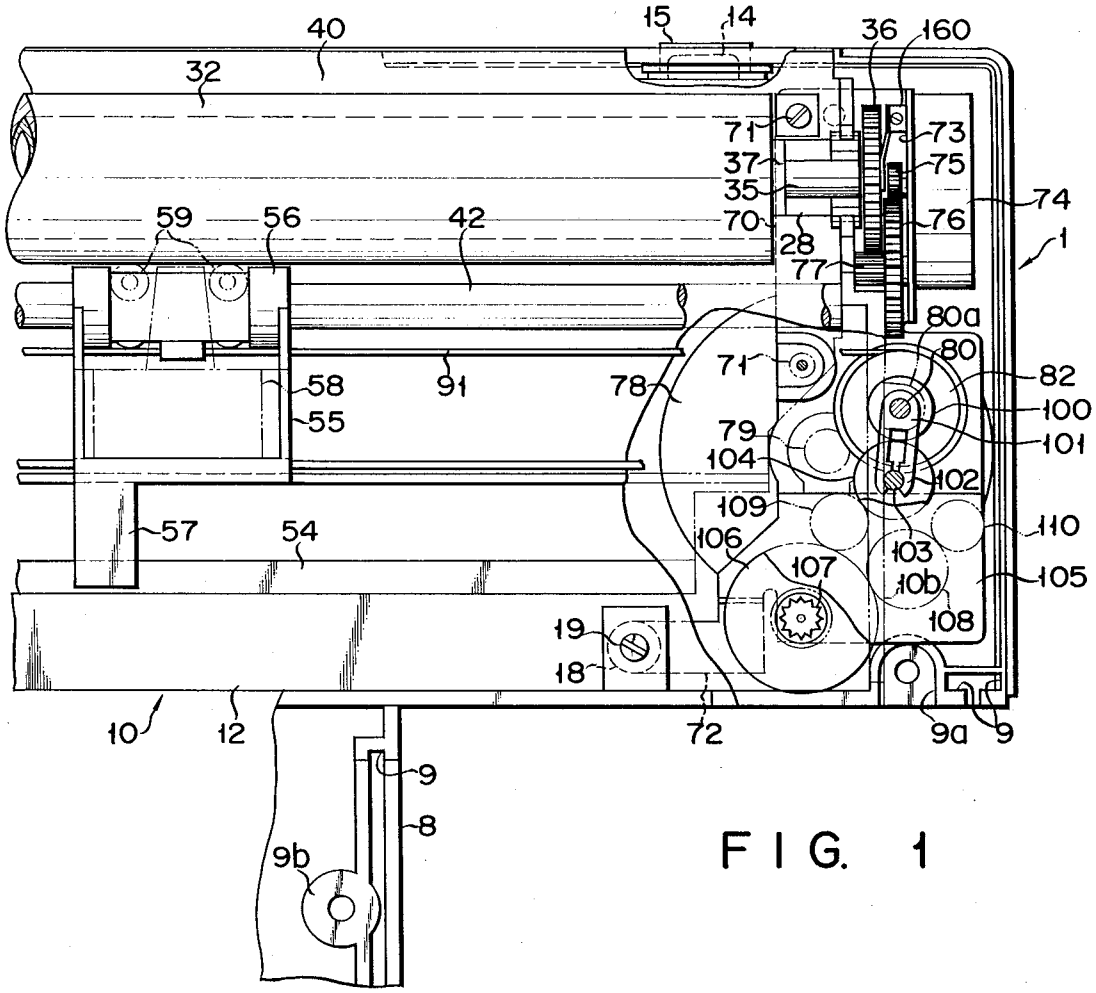
FIG. 1 is a partial, cutaway plan view showing a printer according to the present invention, especially a section including a printing mechanism assembly.
Figure 3:
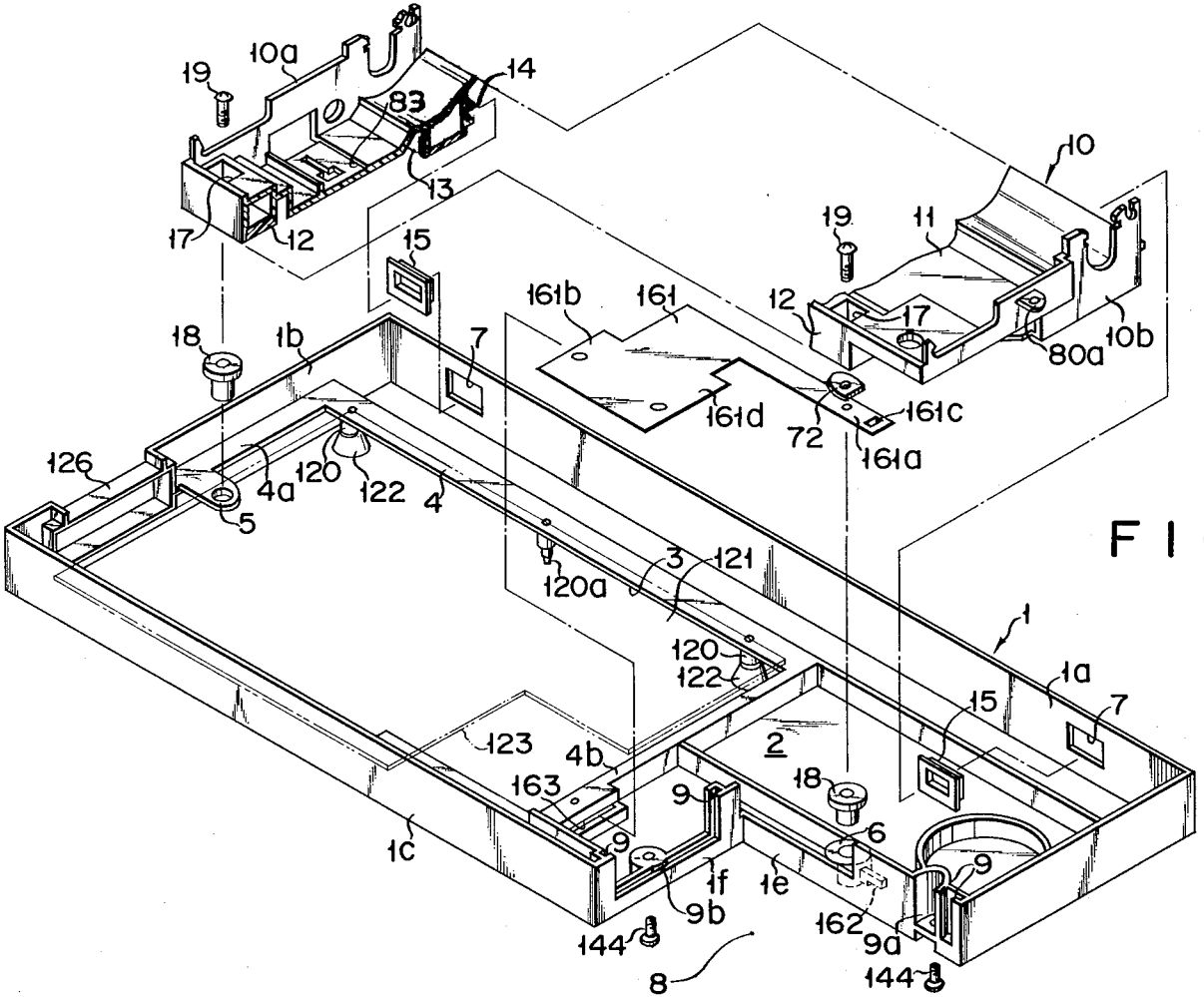
FIG. 3 is an exploded perspective view illustrating the way the subframe is mounted on a main frame.
Figure 4:
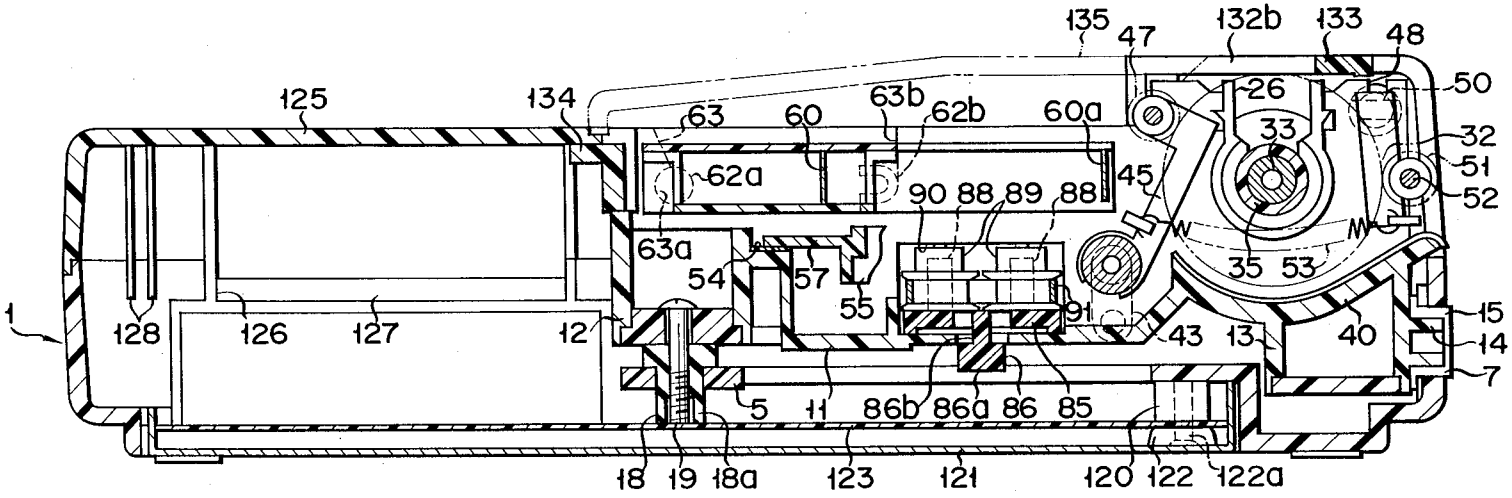
FIG. 4 is a cross-sectional view of the printer.

The construction of a main frame 1 of the printer will be described first. As shown in FIGS. 1, 3 and 4, the main frame is substantially in the form of a bottomed box made of plastic material. A rectangular opening 3 (FIG. 3) is formed in a bottom portion 2 of the main frame 1. A rib 4 having an inverted-L-shaped cross section and adapted to support a printing mechanism assembly or unit (mentioned later) protrudes from predetermined three peripheral edges of the opening 3. A mounting piece 5 for the printing mechanism assembly protrudes integrally inward from the inner edge of a rib portion 4*a* on the left-hand side of FIG. 3. A mounting boss 6 for the printing mechanism assembly is formed integrally on the main frame 1, located on the right of a rib portion 4*b* on the right-hand side of FIG. 3.

A pair of apertures 7 for mounting the printing mechanism assembly are bored through a rear wall 1*a* of the main frame 1 on the side of a platen 32 (mentioned later), spaced right and left.

As shown in FIGS. 1 and 3, a rectangular recess or notch 8 for mounting a power supply unit 140 (mentioned later) is formed at the right-hand front corner portion of the main frame 1. Two pairs of mounting grooves 9, which extend vertically and are open at the top, are formed at predetermined spaces in a pair of side walls 1*e* and 1*f* of the main frame 1 which extend at right angles to each other to define the notch 8. Also, a mounting hollow 9*a* and a mounting boss 9*b* each having a through hole are formed on the side walls 1*e* and 1*f*, respectively.

Printing Mechanism Assembly

Figure 2:
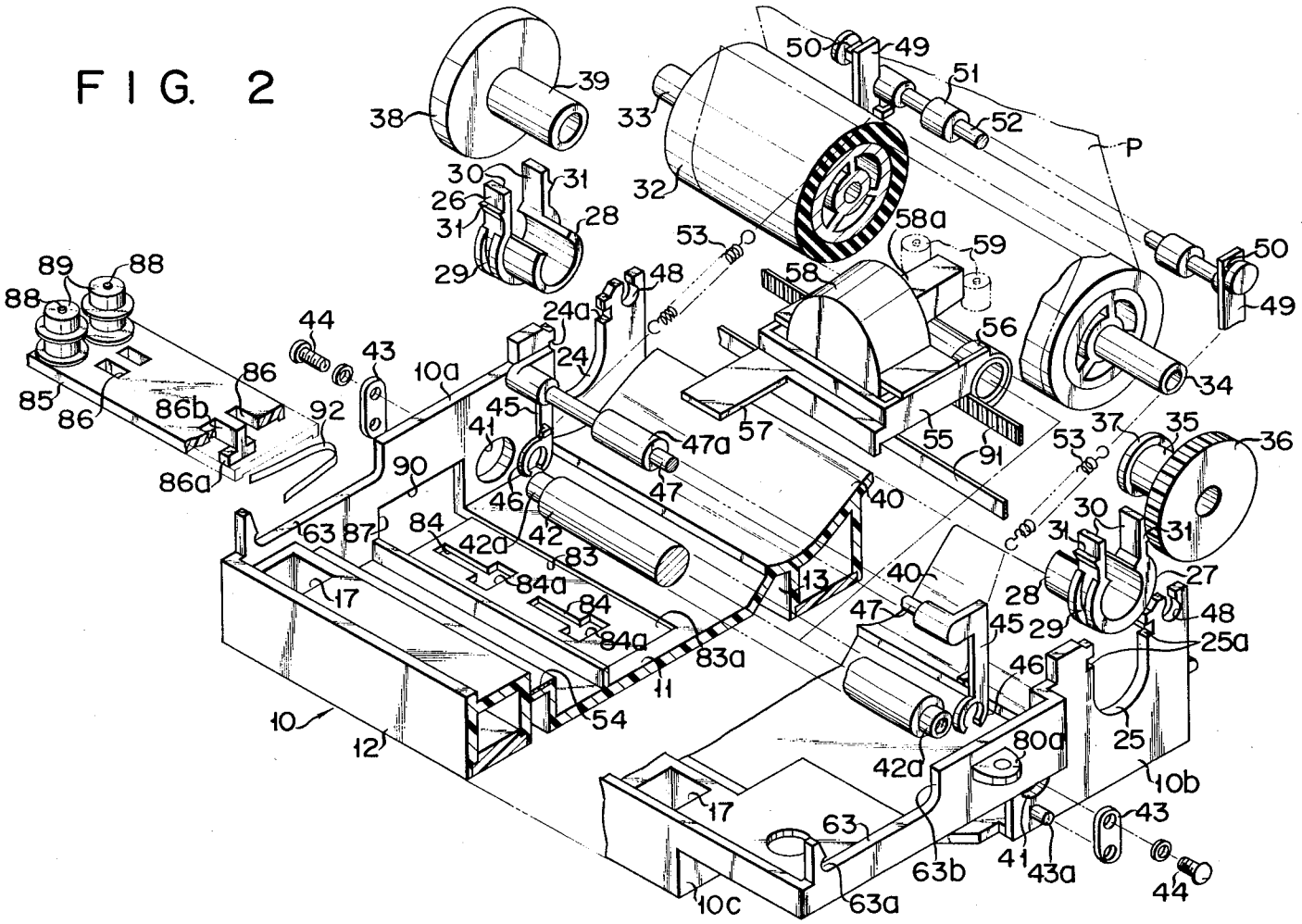
FIG. 2 is an exploded perspective view showing the components of the printing mechanism assembly mounted on a subframe.

The construction of the printing mechanism assembly will now be described in detail. As shown in FIGS. 2 and 3, a subframe 10 of the printing mechanism assembly, like the main frame 1, is in the form of a bottomed box made of plastic material. Front and rear reinforcing blocks 12 and 13, each shaped like a rectangular tube and longitudinally extending parallel to each other, are formed on the front and rear sides, respectively, of a bottom portion 11 of the subframe 10. The reinforcing blocks 12 and 13 are each formed with a number of ribs (not shown) for integrally connecting their transversely facing inside wall portions, whereby their reinforcing effect is enhanced.

The subframe 10, which carries thereon the printing mechanism assembly to constitute a unit structure, as described later, is removably mounted on the rear half portion of the main frame 1.

As shown in FIGS. 3 and 4, projections 14 capable of being loosely fitted in their corresponding apertures 7 of the main frame 1 integrally protrude from the near-end portions of the rear wall of the rear reinforcing block 13, individually. A hat-shaped first vibration-proof member 15 made of rubber is fitted closely on each of the projections 14. The rear portion of the subframe 10 is attached to the main frame 1 in a manner such that each projection 14, along with the first vibration-proof member 15 thereon, is inserted in its corresponding aperture 7 so that the outer surface of the first vibration-proof member 15 is closely in contact with the inside of the aperture 7.

A pair of cavities 17 are formed individually near the left and right ends of the front reinforcing block 12 so as to face the mounting piece 5 and the mounting boss 6, respectively. A flanged cylindrical second vibration-proof member 18 made of rubber is inserted downwardly in each of the respective through holes of the mounting piece 5 and the mounting boss 6. A nut 18*a* is fixedly fitted in the lower portion of a screw hole (not denoted) formed in the center of each second vibration-proof member 18. The outer peripheral surface of the nut 18*a* is in intimate contact with the inner surface of the through hole of the mounting piece 5 or the boss 6 in a manner such that each corresponding vibration-proof member 18 is compressed and diametrically expanded by a fitting screw 19 which is screwed in the nut 18*a*, penetrating the bottom of the cavity 17. In this state, the front portion of the subframe 10 is mounted on the main frame 1.

As shown in the exploded view of FIG. 2, in which the individual components are illustrated in a disassembled state, a pair of U-shaped support recesses 24 and 25 are formed individually in the rear portions of left and right side walls 10*a* and 10*b* of the subframe 10, opening upwardly and facing each other. A pair of locating recesses 24*a* and 25*a* are formed in the upper portions of the respective inner surfaces of the support recesses 24 and 25.

A pair of bearing members 26 and 27 made of plastic material are fitted in the support recesses 24 and 25, respectively. Each of the bearing members 26 and 27 is substantially cylindrical and has a bearing portion 28 open at the top. The bearing portion 28 is formed, on its outer peripheral surface, with a fitting groove 29 which is fitted in the inner edge of its corresponding support recess 24 or 25. A pair of upwardly projecting lugs 30 are formed individually on the edges of the top opening of each bearing portion 28. Locating projections 31 to engage the locating recesses 24a and 25a integrally protrude outward from the outer surfaces of their corresponding lugs 30. The two bearing members 26 and 27 are mounted on the subframe 10 in a manner such that the fitting grooves 29 engages the inner edges of their corresponding support recesses 24 and 25, and locating projections 31 are fitted in their corresponding locating recesses 24a and 25a. In this state, the bearing portions 28 project into the subframe 10.

A platen 32 carrying a printing sheet P thereon is disposed between the two side walls 10a and 10b of the subframe 10 at the rear portion thereof. The platen 32 includes a substantially cylindrical core formed of metal material and a rubber covering on the outer peripheral surface of the core. The core is formed integrally with a pair of shaft portions 33 and 34 which coaxially protrude outward from the two ends of the core. A plastic sleeve 35 is fixedly fitted on the right-hand shaft portion 34 so as to be united therewith. A driven gear 36 and a flange 37 are formed integrally on the right and left end portions of the sleeve 35, respectively. With the sleeve 35 fitted on the shaft portion 34, the outer end portion of the shaft portion 34 slightly projects outward from the driven gear 36.

On the other hand, a plastic sleeve 39 having a knob 38 is fixedly fitted on the left-hand shaft portion 33. As shown in FIGS. 1, 2, 4 and 8, the sleeves 35 and 39 are mounted in the respective bearing portions 28 of their corresponding bearing members 26 and 27, so that the platen 32 is rotatably supported on the subframe 10. In this state, the knob 38 and the driven gear 36 are located outside the left and right side walls 10a and 10b, respectively. The right-hand bearing member 27 is interposed between the flange 37 of the right-hand sleeve 35 and the driven gear 36 so that its end faces abut individually against the flange 37 and the driven gear 36. Thus, the sleeve 35 is prevented from moving relatively to the bearing member 27 in the axial direction, so that the platen 32 is restrained from moving in its longitudinal direction.

Under the platen 32, the subframe 10 is formed integrally with a guide member 40 which, concavely curved along the peripheral surface of the platen 32, serves to guide the printing sheet P forward from behind the platen 32. A pair of apertures 41 are bored individually through the side walls 10a and 10b, facing each other across the region just in front of and below the platen 32. A guide rod 42 extends horizontally in the region between the two apertures 41. Shaft portions 42a smaller in diameter than the apertures 41 protrude individually from both ends of the guide rod 42. The shaft portions 42a are inserted in their corresponding apertures 41 so as to be movable within the same.

As shown in FIG. 2, a rocking lever 43 is rockably supported, at its lower end, on a pin 43a which protrudes from the outer surface of each of the side walls 10a and 10b, located under each corresponding aperture 41. The guide rod 42 is attached to the respective upper ends of the two rocking levers 43 by means of screws 44. Each screw 44 is screwed into a tapped hole formed in the shaft portion 42a at each corresponding end of the guide rod 42. Thus, the guide rod 42 can rock around a lower-end pivotal point 43a of each rocking lever 43 within the extent of the aperture 41. As it rocks, the guide rod 42 may move backward or toward the platen 32.

The shaft portions 42a of the guide rod 42 individually rockably support a pair of substantially arcuate coupling portions 46 which are formed individually at the lower ends of a pair of operating levers 45. A paper bail 47 for supporting paper bail rollers 47a is stretched between the respective upper ends of the two coupling portions 46. The paper bail rollers 47a can rotate while engaging the platen 32. Behind the platen 32, substantially circular support holes 48 are formed individually in the side walls 10a and 10b. A narrow opening is formed at the top of each support hole 48.

A shaft portion 50 attached to the upper end portion of each of a pair of support levers 49 is fitted in each support hole 48. Thus, the support levers 49 are supported so as to be rockable around their corresponding shaft portions 50. Each shaft portion 50 is in the form of a substantially rectangular prism having width and thickness such that it can be inserted into the support hole 48 through the narrow top opening, and can also rotate freely in the hole 48. A rocking shaft 52 is rockably supported between the two support levers 49. The rocking shaft 52 is provided with pressure rollers 51 whereby the printing sheet P fed from above the platen 32 is pressed against the platen 32 to be supplied thereby with a feeding force. A spring 53 is stretched between each combination of the operating lever 45 and the support lever 49 which face each other with the platen 32 between them. The springs 53 continually urge the paper bail rollers 47a of the paper bail 47 and the pressure rollers 51 to be pressed against the platen 32.

At the back of the front reinforcing block 12, a guide member 54 extends along the reinforcing block 12 in the longitudinal direction thereof. A carriage 55 is slidably fitted on the guide rod 42 by means of a sleeve portion 56 which is formed integrally on the back of the carriage 55. A guide piece 57 protrudes from the front of the carriage 54, located so as to be slidable on the upper surface of the guide member 54. Thus, the carriage 55 is supported for longitudinal movement by the guide member 54 and the guide rod 42. The carriage 55 fixedly carries thereon a print head 58 for printing characters each in the form of a dot matrix. A nose portion 58a of the print head 58 is opposed to the platen 32.

A pair of rollers 59 for maintaining a fixed distance between the printing sheet P and the print head 58 are supported on the carriage 55 on either side of the nose portion 58a. Each roller 59 can rotate about a vertical axis extending at right angles to the axis of the guide rod 42. Also, each roller 59 is located so that its outer peripheral surface slightly projects backward or toward the platen 32 beyond the end face of the nose portion 58a. The carriage 55 and the print head 58, along with the guide rod 42, are urged by the springs 53 to move toward the platen 32 through the medium of the operating levers 45.

Figure 10:
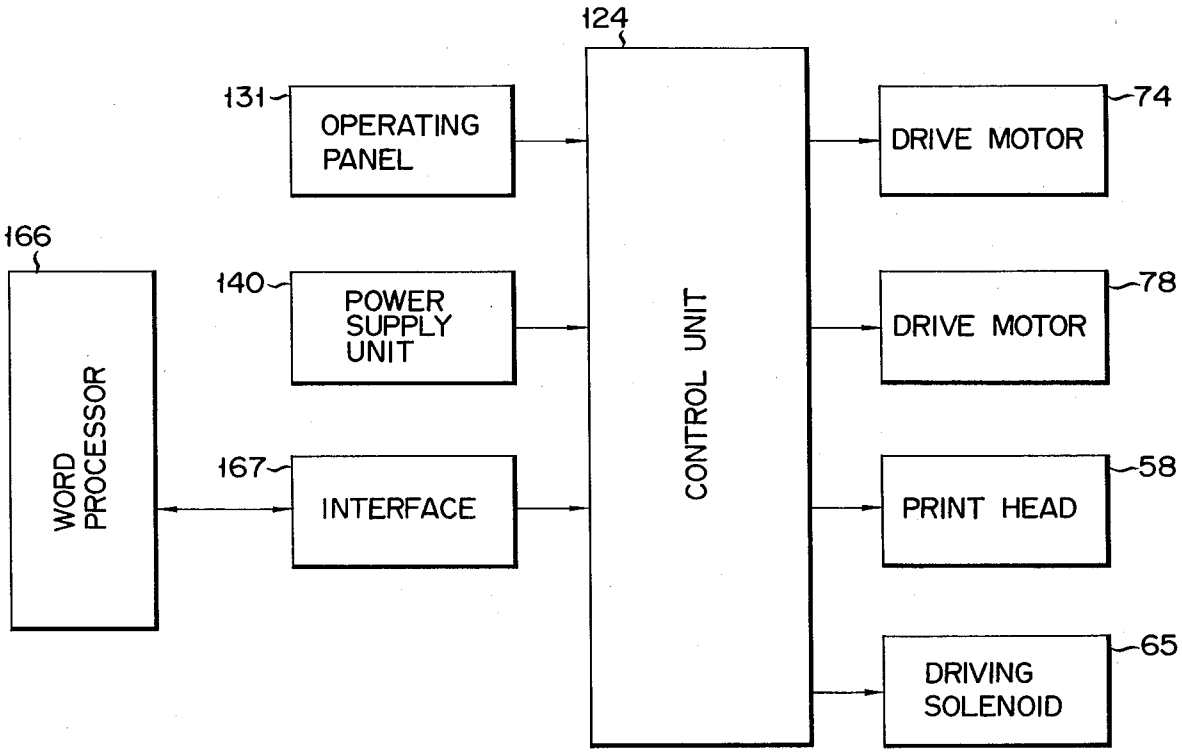
FIG. 10 is a block diagram showing electrical connections between various components or units of the printer including a control unit.

The right-hand rocking lever 43 is coupled with a plunger (not shown) of a driving solenoid 65 (FIG. 10). When the solenoid 65 is actuated, the guide rod 42, along with the two rocking levers 43, is moved away from the platen 32 by the plunger, against the urging force of the springs 53. As a result, the rollers 59 on the carriage 55 are separated from the platen 32. When the solenoid 65 is in returning operation, the guide rod 42, along with the rocking levers 43, is moved toward the platen 32 by the urging force of the springs 53, causing the rollers 59 to be pressed against the printing sheet P on the platen 32. Thus, owing to the rollers 59, the distance between the print head 58 and the printing sheet P can be kept constant independently of the thickness of the sheet P.

Figure 5:
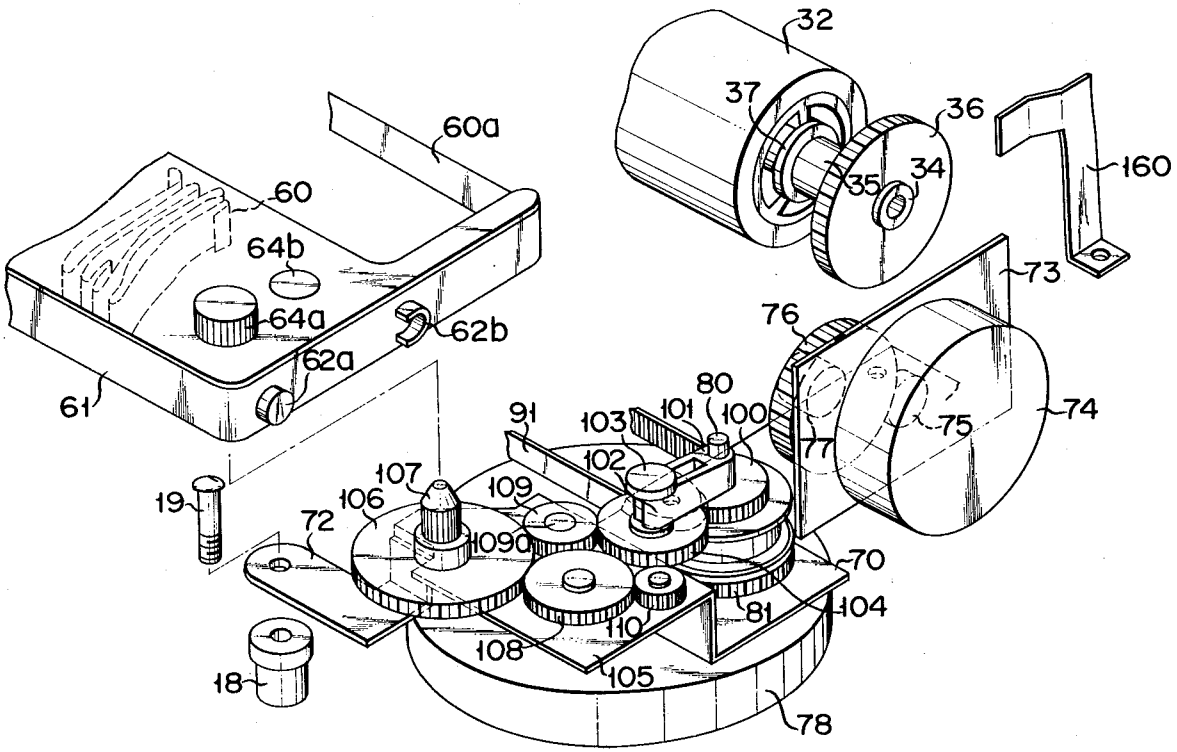
FIG. 5 is a perspective view showing a drive mechanism section of the printing mechanism assembly mounted on a platelike support member.

As shown in FIG. 4, the front reinforcing block 12 carries thereon a ribbon cassette 61 which, including an endless ink ribbon 60, constitutes ribbon holder means. An exposed section 60*a* of the ribbon 60 is stretched between a pair of backwardly projecting guide portions, covering the whole printing region. The exposed ribbon section 60*a* is interposed between the print head 58 and the platen 32. The two side walls 10*a* and 10*b* of the subframe 10 are formed individually with mounting recesses 63 (FIG. 2) in the form of a U-shaped notch. As shown in FIG. 5, a pin-shaped engaging piece 62*a* and a U-shaped engaging piece 62*b*, capable of engaging their corresponding recess 63, protrude from each lateral face of the ribbon cassette 61. As the engaging pieces 62*a* and 62*b* engage their corresponding edges 63*a* and 63*b* of each recess 63, the ribbon cassette 61 is removably held in a mounting position on the subframe 10 by friction.

Figure 6:
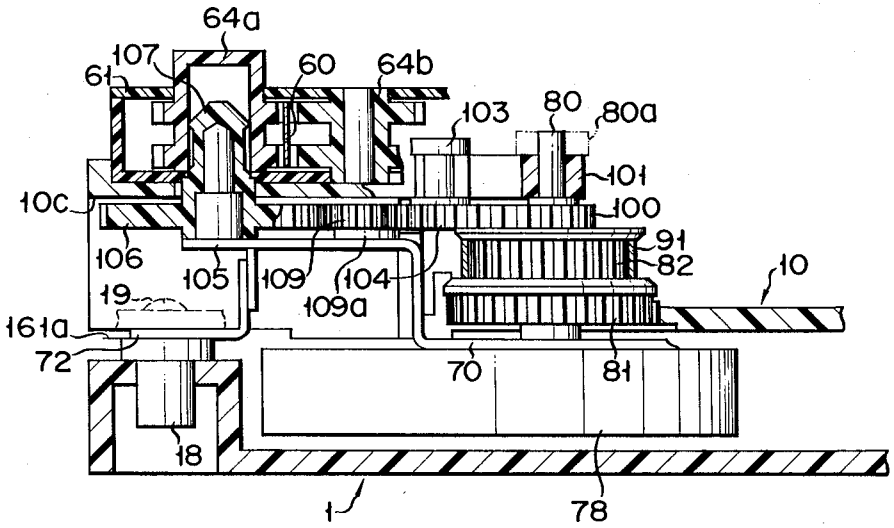
FIG. 6 is a partial sectional view of the section shown in FIG. 5.

As shown in FIGS. 5 and 6, a pair of gear-shaped recovery rollers 64*a* and 64*b* are provided in the right-hand portion of the ribbon cassette 61. As the carriage 55 reciprocates, the one roller 64*a* is rotated in one direction, and the other roller 64*b* is rotated following the roller 64*a*. As a result, the used portion of the ribbon 60 is withdrawn into the cassette 61 through the one guide portion thereof, passing between the two rollers 64*a* and 64*b*, while that portion of the ribbon 60 contained in the cassette 61 is drawn out from the other guide portion of the cassette 61.

The roller 64*a* projects above the top surface of the cassette 61 so that its projecting part constitutes a knob for an operator's turning operation.

Various Drive Mechanisms

A platen drive mechanism will be described first. As shown in FIGS. 1 and 5, a support member 70 formed of a single bent metal plate is attached, at its left side edge portion, to the right-hand portion of the bottom surface of the subframe 10 by means of two screws 71. At the same time, a mounting ear portion 72 protruding from the front side of the support member 70 is fixed to the main frame 1 by means of the right-hand one of the screws 19 (FIGS. 3 and 5). A drive motor 74 for driving the platen 32 is mounted on the outer surface of an upright portion 73 which is formed at the rear portion of the support member 70. A driving gear 75 located inside the upright portion 73 is fixed on the shaft of the motor 74 which penetrates the upright portion 73.

The upright portion 73 supports, on its inner surface, a large-sized intermediate gear 76 in mesh with the driving gear 75, and a small-sized intermediate gear 77 in mesh with the driven gear 36 which is integral with the platen 32. The two intermediate gears 76 and 77 can rotate coaxially in one united body. As the drive motor 74 rotates forward or reversely, therefore, the platen 32 is caused to rotate in the forward or reverse direction through the medium of the gears 75, 76, 77 and 36.

The drive motor 74 and the gears 36, 75, 76 and 77 constitute the platen drive mechanism.

A carriage drive mechanism will now be described. In FIGS. 5 and 6, the support member 70 is mounted, on the lower surface of its central portion, with a flat drive motor 78 used to drive the carriage 55 and for the recovery of the used ribbon 60. A small-sized driving gear (not shown) is fixed on the shaft of the motor 78 which projects upward through the support member 70. A support shaft 80 protrudes upward from the support member 70, adjoining the driving gear. The upper end of the support shaft 80 is fitted in a support lug 80*a* which protrudes from the outer lateral face of the subframe 10. A large-sized intermediate gear 81 in mesh with the driving gear and a toothed driving pulley 82 are supported for integral rotation on the support shaft 80.

As shown in FIGS. 2 and 3, on the other hand, a holding depression 83 is formed in the upper surface of the left-hand bottom portion of the subframe 10. A pair of narrow guide slots 84 are formed in the bottom wall of the depression 83, extending in the carriage transfer direction and properly spaced in the same direction. Each guide slot 84 is adjoined, on its right-hand side, by a fitting slot 84*a* continuous with the guide slot 84 and wider than the same, thus forming a T-shaped aperture. A support plate 85 is set in the holding depression 83. From the lower surface of the support plate 85 protrude a pair of inverted-T-shaped guide pieces 86 each including a lug portion 86*a* adapted to penetrate the fitting slot 84*a* to be located under the subframe 10, and a guide portion 86*b* which, narrower than the lug portion 86*a*, connects the lug portion 86*a* and the support plate 85 and can move along the guide slot 84.

A pair of support shafts 88 protrude from the left-hand portion of the upper surface of the support plate 85, spaced in the transverse direction thereof. A driven pulley 89 is rotatably fitted on each of the support shafts 88. The left side wall 10*a* of the subframe 10 is formed with a vertical opening 87 which connects with the holding depression 83.

A toothed endless drive belt 91 is stretched between the driving pulley 82 and the driven pulleys 89, part of the belt 91 being fixed to the carriage 55. Thus, as the drive motor 78 rotates in the forward and reverse directions, the print head 58, along with the carriage 55, is reciprocated through the medium of the gear 81, the pulleys 82 and 89, and the belt 91. As shown in FIG. 2, moreover, a substantially U-shaped leaf spring 92 is disposed between the right-hand lateral face of the support plate 85 and the inside wall of the holding depression 83. The driven pulleys 89, as well as the support plate 85, are urged to move to the left by the resiliency of the spring 92. Thus, the leaf spring 92 applies tension to the belt 91.

With the belt 91 thus strained by the urging force of the leaf spring 92, the support plate 85 is held in its left-hand end position by the spring 92. In this state, the driven pulleys 89 are located inside the opening 87 so that their upper ends closely face a retaining surface 90 formed on the upper inside face of the opening 87. As seen from FIG. 4, therefore, the driven pulleys 89 are prevented from slipping off their corresponding support shafts 88, caught by the retaining surface 90. Accordingly, it is unnecessary to provide any special retaining means between the pulleys 89 and the support shafts 88.

Thus, the drive motor 78, the gear 81, the pulleys 82 and 89, and the belt 91 constitute the carriage drive mechanism.

A ribbon feed mechanism will now be described. Over the driving pulley 82, as shown in FIGS. 5 and 6, the support shaft 80 is fitted with an intermediate gear 100 which rotates in one with the pulley 82. Above the intermediate gear 100, moreover, a link lever 101 is fitted, at its proximal end, on the support shaft 80 with some friction. A distal end portion 102 of the link lever 101 is forked and rockably holds an operating shaft 103. A transmission gear 104, which is normally in mesh with the intermediate gear 100 is formed integrally on the lower end of the operating shaft 103. The holding force of the distal end portion 102 exerts a frictional resistance on the operating shaft 103 in rocking motion.

As shown in FIGS. 1 and 5, a large-sized driving gear 106 for the ribbon 60 is rotatably supported on the upper surface of a bent portion 105 which is formed at the front part of the support member 70. As shown in FIG. 6, a fitting boss 107 protrudes from the upper surface of the driving gear 106 along its axis. The fitting boss 107 is removably fitted in a bore of the shaft portion of the one recovery roller 64*a*. Also, the bent portion 105 rotatably supports thereon two intermediate transmission gears 108 and 109 of different diameters which are normally in mesh with the driving gear 106. Further, a small-sized intermediate gear 110, normally in mesh with the one intermediate transmission gear 108, is rotatably supported on the bent portion 105. When the link lever 101 swings in the manner mentioned later with a change of the carriage transfer direction, the transmission gear 104 on the operating shaft 103 is shifted to alternatively engage the intermediate transmission gear 109 or the intermediate gear 110.

When the carriage 55 moves to the right of FIG. 1, that is, in a forward feed mode, the drive motor 78 rotates in the clockwise direction, and its rotatory force is transmitted to the link lever 101 by the friction between the support shaft 80 and lever 101. As a result, the link lever 101 is moved to the position shown in FIG. 1, where the transmission gear 104 engages the intermediate transmission gear 109. Accordingly, the intermediate gear 81, the driving pulley 82, and the intermediate gear 100 are rotated in a body in the clockwise direction of FIG. 1 by the drive motor 78, and their rotatory force is transmitted to the driving gear 106 through the transmission gear 104 and the intermediate transmission gear 109. Thus, the driving gear 106 is rotated in the counterclockwise direction of FIG. 1, so that the used portion of the ink ribbon 60 is drawn back into the ribbon cassette 61 as the fitting boss 107 and the recovery roller 64*a*. At the same time, the unused portion of the ribbon 60 is drawn out from the cassette 61.

On the other hand, if the rotating direction of the drive motor 78 is changed to switch the carriage transfer direction from forward to reverse, that is, in a return mode, the rotating direction of the intermediate gear 81, the driving gear 82, and the intermediate gear 100 is changed to the counterclockwise direction of FIG. 1. At the time of the direction change, the link lever 101, the operating shaft 103, and the transmission gear 104 rock together in the counterclockwise direction of FIG. 1 around the support shaft 80, backed up by the friction between the operating shaft 103 and the link lever 101. As a result, the transmission gear 104 is shifted so as to leave the intermediate transmission gear 109 and engage the intermediate gear 110.

Thereafter, as the driving pulley 82 and the intermediate gear 100 continue to rotate in the counterclockwise direction of FIG. 1, the carriage 55 is returned, and the driving gear 106 is rotated in the counterclockwise direction through the medium of the gears 104, 110 and 108, as in the case of the forward carriage transfer. As a result, the used ribbon portion is drawn back into the cassette 61, while the unused ribbon portion is drawn out from the cassette 61.

When the carriage transfer direction is changed from reverse to forward, the link lever 101 is rocked in the same manner as aforesaid to take the position of FIG. 1. Thus, the ribbon feeding direction is fixed without regard to the rotating direction of the drive motor 78.

As shown in FIG. 6, an undersurface 10*d* (FIG. 2) of a notch or recess 10*c* formed in the front bottom portion of the subframe 10 is located close to the upper surface of the intermediate transmission gear 109. Thus, the undersurface 10*d* serves to prevent the intermediate transmission gear 109 from coming off its support shaft 109*a*. It is therefore unnecessary to provide any special retaining means between the support shaft 109*a* and the gear 109. The intermediate gear 100, the link lever 101, the operating shaft 103, and the gears 104, 106, 108, 109 and 110 constitute the ribbon feed mechanism.

As is evident from the above description, the respective driving sections of the platen drive mechanism, the carriage drive mechanism, and the ribbon feed mechanism, which constitute print drive means, are fixed for unitization on the single support member 70, and mounted, as a unit, on the subframe 10. Thus, the subframe 10 carries thereon all the components that constitute the printing mechanism assembly, as a unit.

Construction of Control Unit

As shown in FIGS. 3 and 4, a pair of mounting bosses 120 and locating projections 120*a* protrude from the lower surface of the rib 4 of the main frame 1, arranged at predetermined intervals in the longitudinal direction of the main frame 1. Also, a metallic support plate 121 is attached to the bottom of the main frame 1 so as to cover the opening 3 from under the same. The support plate 121 is formed integrally with projections 122 which protrude upward therefrom, corresponding individually to the mounting bosses 120. The support plate 121 is fixed to the main frame 1 by means of screws 122*a* (FIG. 4) which upwardly penetrate their corresponding projections 122 to be screwed into the mounting bosses 120. A printed board 123, which is mounted with a central processing unit, a character generator, etc., is fixed between and together with the mounting bosses 120 and the projections 122 by the screws 122*a*. The locating projection 120*a* is fitted in an aperture (not shown) in the printed board 123, thereby locating the board 123 in place. The central processing unit, the character generator, and the printed board 123 constitute a control unit 124 (FIG. 9) for controlling the operation of the printing mechanism assembly.

Construction of Cover

Figure 7:
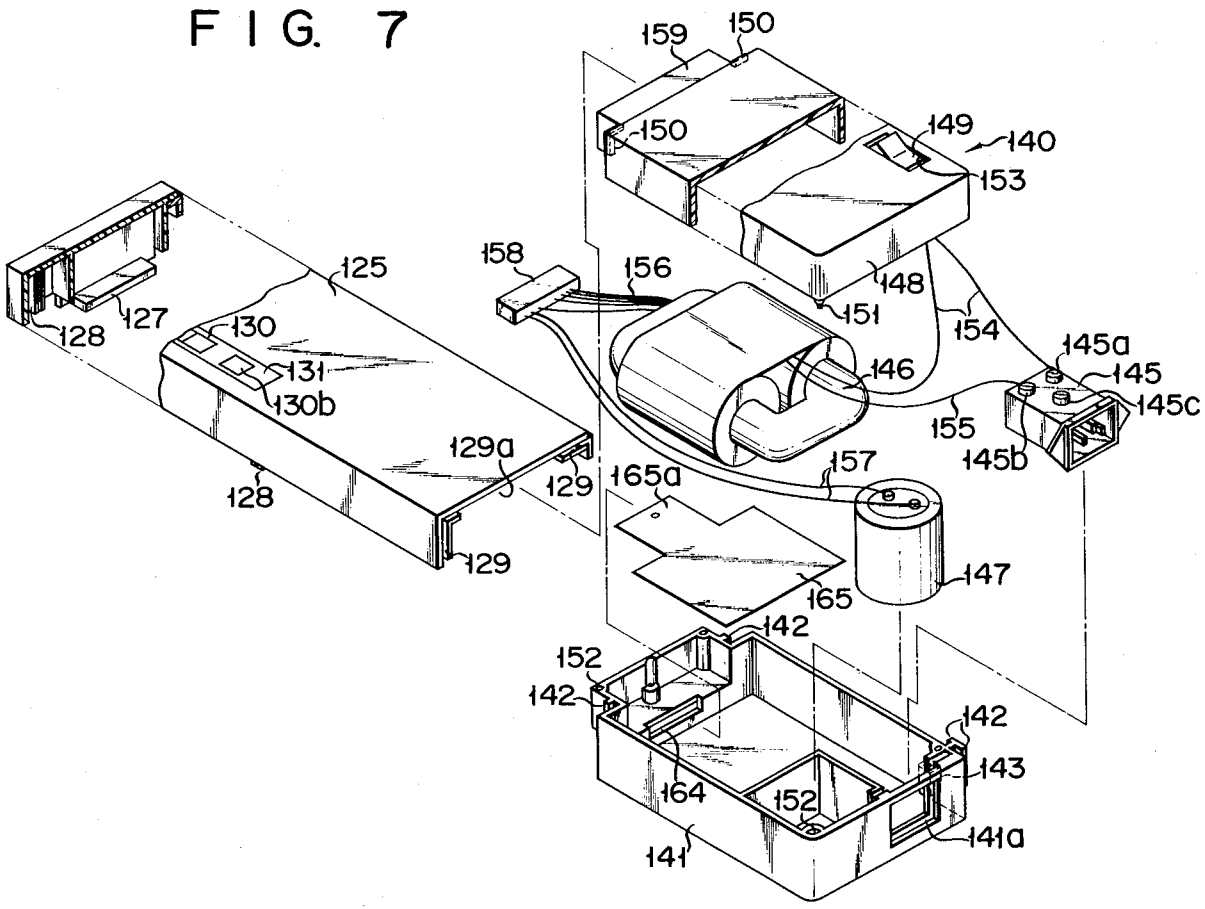
FIG. 7 is an exploded perspective view showing the arrangement of a power supply unit.
Figure 8:
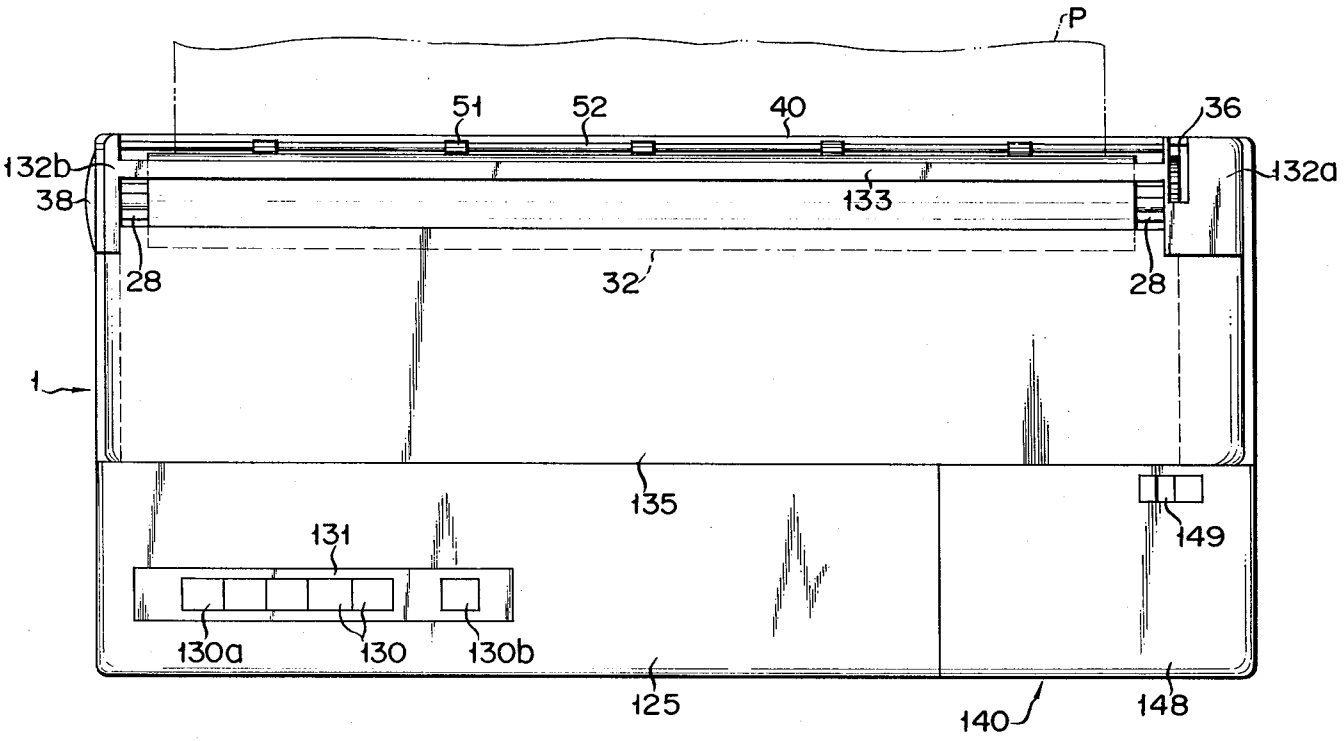
FIG. 8 is a general plan view of the printer.

As shown in FIGS. 4, 7 and 8, a cover 125 is removably mounted on the vertical walls of the main frame 1, corresponding in position to the printed board 123. The cover 125 hangs over the printed board 123, especially a front half portion thereof. The cover 125, which is substantially in the form of a bottomed box made of plastic material, is formed integrally with an engaging projection 127 and a plurality of projecting pieces 128 at the bottom of the left side wall portion, as in FIG. 7. The engaging projection 127 is adapted to releasably engage an engaging recess 126 (FIG. 3) formed in the left side wall 1*b* of the main frame 1, and the projecting pieces 128 to releasably engage the inside of the left side wall 1*b* and the front wall 1*c*. The cover 125 is removably held on the main frame 1 through the engagement between the engaging projection 127 of the cover 125 and the engaging recess 126 of the main frame 1, and between the projecting pieces 128 and the inside of the vertical walls of the main frame 1. The cover 125 can be lifted up to be detached from the main frame 1 after removing the engagement. When the cover 125 is removed, the front half of the printed board 123 is exposed. The cover 125 is formed, on its right-hand end face as in FIG. 7, with a pair of engaging pieces 129 which define a coupling recess 129*a* opening to the right. Further, the cover 125 bears thereon an operating panel 131 (FIGS. 7 to 9) which is provided with various operating switches 130. If any of the operating switches 130 is depressed, a predetermined signal is applied to the input of the control unit 124. If the cover 125 is taken away from the main frame 1, the printed board 123 can easily be accessed through the opening 3 of the main frame 1. Thus, it is very easy to perform maintenance or inspection of a control circuit on the printed board 123.

Moreover, a side cover 132*a*, hanging over the right-hand portion of the support member 70, as shown in FIG. 8, is provided on the right side wall 1*d* (FIG. 3) of the main frame 1 at the rear portion thereof. On the other hand, a side cover 132*b* is put on the left side wall 1*b* of the main frame 1 so as to cover the left end face of the platen 32. Rear and front connecting members 133 and 134 are integrally formed between the two side covers 132*a* and 132*b* so as to connect the same. The front connecting member 134 is shown in FIG. 4. As shown in FIGS. 4 and 8, the rear connecting member 133 lies over the rear portion of the platen 32, while the front connecting member 134 is interposed between the front wall of the subframe 10 and the rear edge portion of the cover 125.

As shown in FIGS. 4 and 8, moreover, a transparent plastic sub-cover 135 is removably mounted between the side covers 132*a* and 132*b*, hanging over the ribbon cassette 61 and part of the platen 32. Thus, the main frame 1 and the covers 125, 135, 132*a* and 132*b* constitute a main body casing of the printer.

Construction of Power Supply Unit

A power supply unit 140 is removably mounted in the notch 8 which is defined at the front corner portion of the main frame 1 shown in FIG. 3. As shown in FIG. 7, a casing 141 of the power supply unit 140 is in the form of a bottomed box. The casing 141 is formed integrally, on the outer surface of its peripheral wall, with four vertical coupling ridges 142 adapted to be vertically removably fitted in the four mounting grooves 9 shown in FIG. 3, and a mounting piece 143 also shown in FIG. 7 adapted to be downwardly inserted into the mounting hollow 9*a* also shown in FIG. 3. The mounting piece 143, which is indicated by chain line in FIG. 7, protrudes from the outer surface of the rear wall of the casing 141. With the coupling ridges 142 in their corresponding mounting grooves 9 and the mounting piece 143 in the mounting hollow 9*a*, the casing 141 is fixed to the main frame 1 by means of screws 144 which are screwed in the mounting piece 143 and the bottom wall of the casing 141 through the bottom of the mounting hollow 9*a* and the mounting boss 9*b*, respectively.

As shown in FIG. 7, the casing 141 contains a three-terminal connector 145 adapted to be connected to an external power supply cord (not shown) for the supply of a high voltage from an external power source, a transformer 146 for changing the high voltage into a predetermined low voltage suited for the drive of the printer, and a capacitor 147. When housed in the casing 141, the connector 145 faces an opening 141*a* of the casing 141 and can be connected to the external power supply cord. A box-shaped power supply unit cover 148 is removably mounted on the casing 141 so as to hang over the same. The mounting position of the cover 148 is determined when a plurality of legs 151 attached to the cover 148 are fitted in their corresponding holes 152 in the top edges of the casing 141.

The cover 148 is provided with a switch 149, which is exposed from the top of the cover 148 through an opening 153 to permit an operator's operation.

The switch 149 is connected between a terminal 145*a* of the connector 145 and one of a pair of terminals (not shown) on the high-voltage input side of the transformer 146 by means of lead wires 154. The other terminal of the transformer 146 is connected to a terminal 145*b* of the connector 145 by means of a lead wire 155.

A female connector 158 is connected to the other ends of lead wires 156 and 157 which extend from connecting terminals (not shown) on the low-voltage output side of the transformer 146 and the capacitor 147, respectively. The female connector 158 is removably fitted on a male connector (not shown) on the printed board 123 which constitute the low-voltage input section of the control unit 124 (FIG. 10). As the mating connectors thus engage each other, the power supply unit 140 is electrically connected to the printed board 123.

When the switch 149 is closed, with the power supply unit 140 connected in the aforesaid manner, a high-voltage current from the external power source (not shown) is supplied, through the power supply cord (not shown), the three-terminal connector 145, and the lead wires 154, to the high-voltage input section of the transformer 146, where it is changed into a low-voltage current. The low-voltage current is delivered from the low-voltage output section of the transformer 146, and supplied to the printed board 123 of the control unit 124 through the releasable connection between the female connector 158 and its mating male connector (not shown) on the printed board.

To perform the aforementioned printing operation, the control unit 124 supplies low-voltage power to the various drive mechanisms.

The power supply unit 140 is an integral unit which is formed by mounting the three-terminal connector 145, the transformer 146, and the capacitor 147 in the casing 141, and then putting the cover 148 on the casing 141. Constructed in this manner, the unit 140 can be detachably mounted on the main frame 1. The female connector 158 can be connected to the male connector of the printed board 123 through an open end portion of a coupling boss 159.

As shown in FIG. 7, the coupling boss 159 opening at its outer end, as well as a pair of engaging pieces 150, protrudes from the left end face of the cover 148 of the power supply unit 140. If the cover 148 is put on the casing 141 while the casing 141 is on the main frame 1, the coupling boss 159 is inserted in the coupling recess 129*a*, and the engaging pieces 150 of the cover 148 engage their corresponding engaging pieces 129 of the cover 125, thereby connecting the two covers 148 and 125. This indicates that the power supply unit 140 can be removably coupled to the cover 125.

Figure 9:
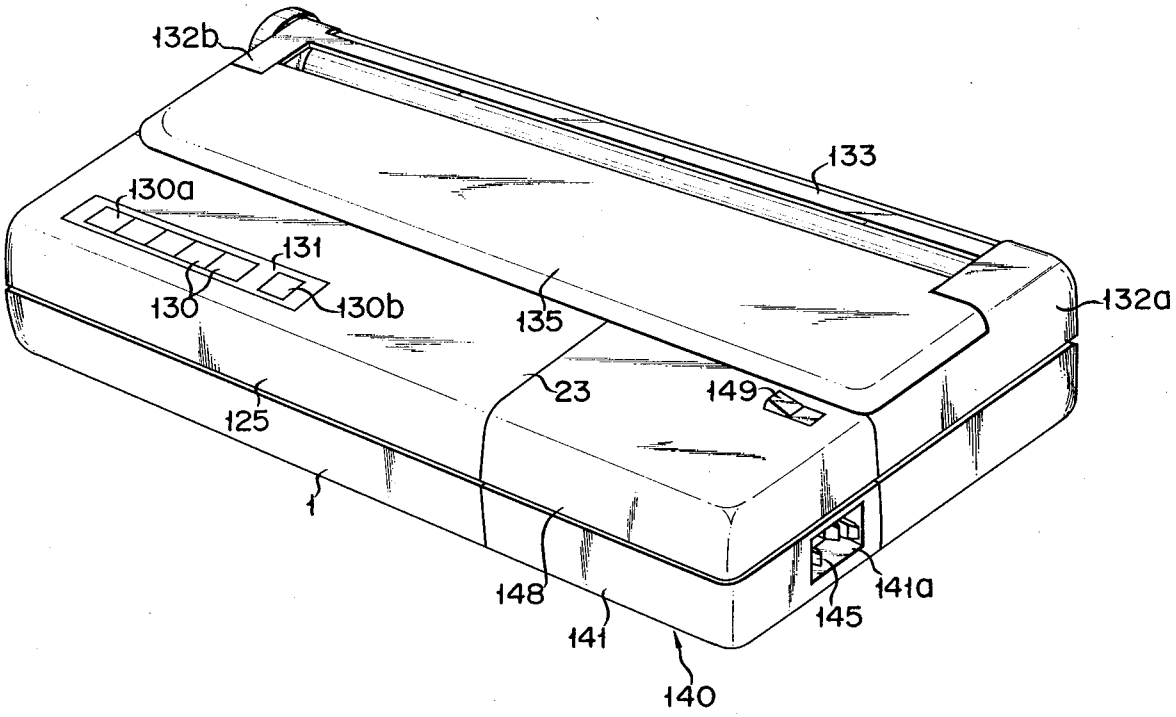
FIG. 9 is a general perspective view of the printer.

When the power supply unit 140 is mounted in the notch 8 of the main frame 1 in this manner, as shown in the general perspective view of FIG. 9, the outer peripheral surfaces of the power supply unit 140 become flush or smoothly continuous with those of the main frame 1, the covers 125 and 135, and the side cover 132, defining a substantially solid outline of the printer shaped like a round-cornered rectangular prism. Thus, the casing 141 and the cover 148 of the power supply unit 140 constitute a power supply unit casing, which, having smooth outer peripheral surfaces, looks like a solid or integral body. In other words, the power supply unit casing can be removably attached to the main body casing. When these two casings are joined together, the outer peripheral surfaces of the unit casing become flush or smoothly continuous with those of the main body casing, defining generally a rectangular outline of the printer. The power supply unit 140, when attached to the main body casing, can thus enjoy the solid external appearance also because the casing 141 and the power supply unit cover 148 are arranged side by side with the main frame 1 and the cover 125, respectively, and because the dividing line between the main frame 1 and the cover 125 is in alignment with that between the casing 141 and the cover 148.

Arrangement for Static Electricity Removal

There will now be described an arrangement for removing static electricity which may be produced between the platen 32 and the printing sheet P during sheet feeding operation based on the rotation of the platen 32.

As shown in FIGS. 1 and 5, a bent elastic strip 160 made of metal is screwed, at its proximal end, to the upper surface of the support member 70, located between the driven gear 36 and the upright portion 73 of the support member 70. The distal end of the elastic strip 160 is pressed against the end face of the right-hand shaft portion 34 of the platen 32. As shown in FIG. 3, moreover, a conductor sheet 161, formed of aluminum foil or other conductive material, is placed on the bottom portion 2 of the main frame 1, adjoining the notch 8. A narrow portion 161*a* of the sheet 161 is anchored, by means of its retaining hole 161*c*, to a retaining piece 162 which protrudes from the mounting boss 6. The narrow portion 161*a* is interposed between the mounting strip 72 of the support member 70 and the second vibration-proof member 18, and all these members are fixed together on the main frame 1 by means of the screw 19.

A slit 163 is formed in the main frame 1, corresponding to a left-hand wide portion 161*b* of the sheet 161. The sheet 161 is brought fixedly into contact with the support plate 121, by means of a screw (not shown), in a manner such that the wide portion 161*b* is bent and inserted in the slit 163. A right-hand wide portion 161*d* of the sheet 161 is placed on the mounting boss 9*b*.

As shown in FIG. 7, moreover, a conductor sheet 165 is interposed between the bottom face of the casing 141 of the power supply unit 140 and the transformer 146. A left end portion 165*a* of the sheet 165 penetrates a slit 164 in the casing 141 to be located on the mounting boss 9*b*. Overlapping each other on the boss 9*b*, the two sheets 161 and 165 are fixed together, for electrical conduction, on the main frame 1 by means of the screw 144 shown in FIG. 3. Also, the sheet 165 is connected to an earth terminal 145*c* of the three-terminal connector 145.

Accordingly, the shaft portion 34 of the platen 32 is electrically connected to the earth terminal 145*c* and the support plate 121 for the control unit 124 by means of the elastic strip 160, the support member 70, and the sheets 161 and 165. It is therefore possible to ground static electricity which may be produced between the platen 32 and the printing sheet P, thereby preventing various circuit elements on the support plate 121 from being damaged.

Operation

The printer with the above-mentioned construction may, for example, be connected to a word processor 166 by means of an interface 167, as shown in FIG. 10, so that character data stored in the word processor 166 is printed out. In doing this, the switch 149 shown in FIGS. 8 and 9 is first turned on to connect the control unit 124 to the power supply. Then, a sheet feed switch 130*a* on the operating panel 131 is turned on to cause the control unit 124 to actuate the driving solenoid 65. Thereupon, the plunger of the solenoid 65 drives the carriage 55 through the medium of the rocking lever 43 and the guide bar 42, so that the rollers 59 are separated from the platen 32.

Subsequently, the printing sheet P is inserted between the platen 32 and the pressure rollers 51 from behind the platen 32, with the pressure rollers 51 kept apart from the platen 32 against the urging force of the springs 53 shown in FIG. 2. Thereafter, the platen 32 is rotated by means of the knob 38 shown in FIG. 2, so that the printing sheet P is transported to the side of the print head 58 by the joint action of the platen 32 and the pressure rollers 51 following the rotation of the platen 32. As a result, the leading edge of the printing sheet P passes between the platen 32 and the rollers 59 to be inserted between the platen 32 and the paper bail rollers 47*a* of the paper bail 47.

When a print start switch 130*b* on the operating panel 131 is turned on, the control unit 124 actuates the driving solenoid 65 for return operation, thereby causing the rollers 59 to engage the printing sheet P on the platen 32. At the same time, the control unit 124 delivers predetermined driving signals to the drive motors 74 and 78 and the print head 58 through a driving circuit.

As the drive motor 78 rotates in the forward direction, the intermediate gear 81, the driving pulley 82, and the intermediate gear 100 rotate in a body in the clockwise direction of FIGS. 1 and 5, and the belt 91 circulates in the clockwise direction of FIG. 5, thereby moving the carriage 55, along with the print head 58 thereon, in the forward direction. While moving in this manner, the print head 58 is actuated to perform printing on the the printing sheet P.

While the carriage 55 is moving in the forward direction, the transmission gear 104 on the link lever 101 is in mesh with the second intermediate transmission gear 109, so that the clockwise rotation of the intermediate gear 100 is transmitted to the ribbon driving gear 106 via the gears 104 and 109. Accordingly, the driving gear 106 is rotated in the counterclockwise direction of FIG. 1, so that the used portion of the ribbon 60 is drawn back into the cassette 61 by the recovery rollers 64, and the unused ribbon portion is drawn out from the cassette 61, in association with the movement of the print head 58.

After a printing operation for one line ends, the drive motor 74 is rotated through a predetermined angle in the forward direction, so that the platen 32 is rotated in the clockwise direction of FIG. 5 through the medium of the gears 75, 76 and 77 and the driven gear 36. As a result, the printing sheet P undergoes a line feed for one line. Meanwhile, the operating shaft 103 of the transmission gear 104 is held by the link lever 101, and the transmission gear 104 is in mesh with the intermediate gear 100. When the drive motor 78 is then rotated in the reverse direction to reverse the intermediate gear 100, therefore, the transmission gear 104 and the link lever 101 are swung in the counterclockwise direction of FIG. 1 around the support shaft 80. At the start of the reverse rotation of the intermediate gear 100, the transmission gear 104 is stopped. Thus, the transmission gear 104 leaves the second intermediate transmission gear 109, and engages the intermediate gear 110 instead.

As the drive motor 78 continues to rotate in the reverse direction, the print head 58 performs printing operation while the carriage 55 is being returned. While the carriage 55 is moving in the returning direction, the ribbon driving gear 106 is rotated in the counterclockwise direction of FIG. 1, as in the case of the forward carriage transfer, through the medium of the gears 100, 104, 110 and 108, based on the engagement between the transmission gear 104 and the intermediate gear 110. Thus, the used ribbon portion is drawn back into the ribbon cassette 60, while the unused portion is drawn out therefrom.

Assembly of Printer

There will now be described processes of assembling the printer according to the present invention.

First, processes of assembling the printing mechanism unit, including the platen 32, the carriage 55, and the ribbon cassette 61, will be described. The sleeves 39 and 35 are fixedly put on the shaft portions 33 and 34 of the platen 32, respectively, and the opening edges of the bearing portions 28 of the bearing members 26 and 27 are then caused to engage the sleeves 39 and 35, respectively. If the bearing members 26 and 27, in this state, are pressed against their corresponding sleeves 39 and 35, their openings are extended on account of their resiliency to allow the bearing portions 28 to be fitted on the sleeves 39 and 35 for relative rotation.

Then, if the bearing members 26 and 27 are fitted in the support recesses 24 and 25 of their corresponding side walls **10*a* and 10*b* of the subframe 10, the platen 32 is rotatably positioned between the two side walls 10*a* and 10*b*. Subsequently, the lug portions 86*a* of the guide pieces of the support plate 85, with the driven pulleys 89 thereon, are inserted first into their corresponding wide fitting slots 84*a*, and then slidingly fitted into the narrow guide slots 84. Thus, the lug portions 86*a* are prevented from slipping out from the fitting slots 84*a***.

Then, the print head 58 is fixedly mounted on the carriage 55 with part of the belt 91 previously fixed thereon, and the carriage 55, along with the print head 58 thereon, is mounted on the guide rod 42. After this, the two end shaft portions **42*a* of the guide rod 42 are inserted into their corresponding apertures 41, and the guide rod 42 is fixed to the subframe 55 by means of the rocking levers 43 and the screws 44. Also, the front guide piece 57 of the carriage 55 is placed on the guide member 54, and the rollers 59 on the carriage 55 are caused to engage the platen 32**.

Thereafter, the respective coupling portions 46 of the left and right operating levers 45 are fitted on their corresponding shaft portions **42*a* of the guide rod 42, and the respective shaft portions 50 of the left and right support levers 49 are fitted in the support holes 48 of their corresponding side walls 10*a* and 10*b* of the subframe 10. Moreover, the springs 53 are stretched between the operating levers 45 and the support levers 45 corresponding thereto to bring the paper bail rollers 47*a* of the paper bail 47 and the pressure rollers 51 into contact with the platen 32**.

In assembling the printing mechanism unit, especially in the unit assembly of the drive section including the drive motors 74 and 78, on the other hand, the drive motor 74 and the gears 75, 76 and 77 are mounted on the upright portion 73 of the support member 70. Also, the drive motor 78 is attached to the underside of the central portion of the support member 70, while the intermediate gear 81, driving pulley 82, intermediate gear 100, link lever 101, and transmission gear 104 are mounted on the support shaft 80. Moreover, the gears 106, 108, 109 and 110 are mounted on the bent portion 105 of the support member 70, and the elastic strip 160 is fixed beside the driving gear 75. Thus, the drive section is set up as a unit on the single support member 70.

Then, with part of the belt 91 wound around the driving pulley 82, the drive section unit is placed on the right-hand portion of the subframe 10 shown in FIGS. 1 and 2, and the opposite part of the belt 91 is then wound around the driven pulleys 89. In this state, the support shaft 80 is inserted into the hole of the support lug **80*a* formed on the subframe 10, and the unit is fixed to the subframe 10 by means of the two screws 71 (FIG. 1). Subsequently, the support plate 85 is moved to the left, and the spring 92 is put into the space between the support plate 85 and the right-hand inner wall of the holding depression 83**.

Thereupon, the driven pulleys 89 are located inside the opening 87, and their upper end portions are opposed to the retaining surface 90 by the urging force of the spring 92. At the same time, the belt 91 is strained by the urging force of the spring 92. The print head 58 is located between the two longitudinal sides of the belt 91 so that its bottom portion projects below the belt 91.

By the aforementioned assembly work, the whole printing mechanism assembly is unitized and fixed on the subframe 10.

Referring now to FIG. 7, processes of assembling the power supply unit 140 will be described. First, the conductor sheet 165 is placed on the inner bottom surface of the casing 141 so that its left end portion **165*a* is inserted in the slit 164. Then, the three-terminal connector 145, the transformer 146, and the capacitor 147, which are electrically connected beforehand, are set in place in the casing 141. Thereafter, the cover 148, with the switch 149 previously mounted thereon, is fixed on the casing 141. Thus, the assembly of the power supply unit 140** is completed.

Meanwhile, the printed board 123 shown in FIG. 3 is mounted with various necessary elements to constitute the control unit 124, and the cover 125 shown in FIG. 7 is fitted with the operating panel 131.

Mounting work for the unitized components of the printer will now be described. Before mounting the printing mechanism unit on the main frame 1, the printed board 123 of the control unit 124, with the various elements thereon, and the support plate 121 are fixed to the mounting bosses 120 from under the main frame 1 in a manner such that the printed board 123 is located by the locating projection 120*a*. Then after the second vibration-proof members 18 are inserted individually into the holes of the mounting strip 5 and the mounting boss 6, the narrow portion 161*a* of the conductor sheet 161 is attached to the projection of the mounting boss 6, and the left-hand wide portion 161*b* is inserted into the slit 163. Thereafter, the wide portion 161*b* is fixed to the support plate 121 by means of screws (not shown). Then, the subframe 10 is attached, from above, to the rear half portion of the main frame 1 in the following manner. The first vibration-proof members 15 are fitted on their corresponding projections 14 of the subframe 10 shown in FIG. 3. Then, the members 15, along with the projections 14, are fitted rearward into their corresponding apertures 7 of the main frame 1, and the front portion of the subframe 10 is placed on the second vibration-proof members 18. At this time, each first vibration-proof member 15 is brought closely into contact with the outside and inside, respectively, of its corresponding projection 14 and aperture 7. In this state, if the screws 19 are screwed into the nuts 18*a* in the second vibration-proof members 18, the members 18 are compressed and extended in diameter so that their outer peripheral surfaces are in intimate contact with the inner surfaces of the holes of the mounting strip 5 and the mounting boss 6. Thus, the subframe 10 can be fixed on the main frame 1 more easily and elastically with the aid of the vibration-proof members 15 and 18. Namely, the vibration-proof members 15 and 18 serve to absorb undesired external shocks. As a result of the mounting work described above, the mounting strip 72 shown in FIGS. 3 and 5 is electrically connected to the conductor sheet 161.

Then, the coupling ridges 142 of the casing 141 of the power supply unit 140 shown in FIG. 7 are downwardly inserted into their corresponding mounting grooves 9 of the main frame 1, and the mounting piece 143 is fitted into the mounting hollow 9*a*. In this state, the power supply unit 140 is fixed to the main frame 1 by driving the screws 144 from under the main frame 1, at the end of the mounting work. Thus, the conductor sheet 165 in the casing 141 and the conductor sheet 161 are fixedly joined together. Thereupon, the shaft portion 34 of the platen 32 is electrically connected to the earth terminal 145*c* of the three-terminal connector 145 via the elastic strip 160, the support member 70, and the conductor sheets 161 and 165. The power supply unit 140 and the control unit 124 are electrically coupled by connecting the female connector 158 to the male connector (not shown) on the printed board 123.

Subsequently, the front and rear connecting members 134 and 133, along with the right and left side covers 132*a* and 132*b*, are fixed on the front wall and the side walls 10*a* and 10*b* of the subframe 10. Also, the ribbon cassette 61 is placed on the front portion of the subframe 10 so that the engaging pieces 62*a* and 62*b* of the cassette 61 engage the mounting recesses 63 on either side, and that the one recovery roller 64 is fitted on the fitting boss 107 shown in FIG. 5. Thus, the cassette 61 is mounted on the subframe 10 in a manner such that the exposed section 60*a* of the ink ribbon 60 is situated between the print head 58 and the platen 32. At this time, the cassette 61 is located for its longitudinal position by the side covers 132*a* and 132*b*.

Then, the coupling boss 159 of the cover 148 of the power supply unit 140 shown in FIG. 7 is inserted into the coupling recess 129*a* of the cover 125 of the main frame 1 so that the engaging pieces 150 of the cover 148 engage their corresponding engaging pieces 129 of the cover 125. Further, the projecting pieces 128 and the engaging projection 127 on the cover 127 are caused to engage the inside of the corresponding side wall and the engaging recess 126, respectively, of the main frame 1 shown in FIG. 3. Thus, the mounting of the cover 125 on the main frame 1 can easily be accomplished. This is the end of the entire assembly work for the printer according to the present embodiment.

According to the embodiment described above, as shown in FIG. 3, the printed board 123 can be singly disengaged downward from the main frame 1 with ease after removing the support plate 121. Also, the power supply unit 140 can easily be singly removed sideways from the main frame 1 after loosening the two screws 144. Moreover, the printing mechanism unit can be singly removed upward from the main frame 1 after loosening the two screws 19. Since the mounting or removing directions of these units are different, furthermore, the units will never interfere with one another. Thus, the units are easy of access for maintenance, inspection, or replacement.

According to the above described embodiment, moreover, the platen 32 is disposed over the rear portion of the main frame 1, leaving an open space behind it. Therefore, the printing sheet P, such as a continuous sheet or postcard, can be smoothly fed forward between the platen 32 and the guide member 40, permitting easy handling.

When using the printer of the embodiment in districts where different external supply voltages are employed, it is necessary to provide the printer alternatively with various power supply units 140 which are previously furnished with transformers 146 whose voltage on the low-voltage output side is a rated one for the printer, and whose voltage conversion factors are different. Thus, the printer is adapted for use in a wide area if only the power supply units with the different voltage conversion factors are replaced according to the districts. Besides, the replacement is very easy. Since the power supply unit 140 is isolated from the drive section of the printer by the unit casing assembly including the casing 141 and cover 148, moreover, it will never be influenced by heat even if the temperature rises during the operation of the printer. Also, the unit casing assembly, whose three outer peripheral surfaces are exposed to the outside, can provided a satisfactory heat radiation effect.

According to the printer of the invention, furthermore, only the low-voltage current is applied to the input, so that the electrical standard requirements can be fulfilled by the use of a simple arrangement, permitting reduction in manufacturing cost.

Although the present invention has been described with respect to a presently preferred embodiment, it will be appreciated by those skilled in the art that various modifications, substitutions, etc. can be made without departing from the spirit and scope of the invention as defined in and by the following claims.

What is claimed is:

1. A printer comprising:

a main body casing having a frontwardly extending portion and a rearwardly extending portion, said main body casing including a main frame extending between said frontwardly extending portion and said rearwardly extending portion, said frontwardly extending portion of the main body casing including a main cover at one side thereof and a recess at the other side thereof, said main cover being mounted on said main frame;

a printing mechanism unit for printing operation, said printing mechanism unit being mounted on said rearwardly extending portion of the main body casing and including a platen for supporting a printing sheet, a carriage having a print head and movable relatively to the platen, platen drive means, and carriage drive means for moving the carriage, said platen extending substantially over the width of the main frame;

said main body casing further having a subcover which is removably mounted on said main frame to be located above said printing mechanism unit and to be removable independently of said main cover;

a control unit for controlling the printing operation of the printing mechanism unit, said control unit being mounted in the frontwardly extending portion of the main body casing and including first switch means which is mounted on said main cover;

power supply means for supplying electric power to the printing mechanism unit for printing operation; and a power supply means casing containing the power supply means and removably attached to the main body casing in said recess, so that the power supply means, the control unit and the printing mechanism unit are electrically connected when the power supply means casing is attached to the main body casing, said power supply means including a high-voltage input means adapted to be connected to an external power source for high-voltage power input, transforming means for changing a high-voltage input current into a predetermined low-voltage current lower in potential than the input current, low-voltage output means for delivering the low-voltage current transformed by the transforming means to the control unit and the printing mechanism unit, said low-voltage output means having a connector removably connected to the main body casing, and second switch means for switching the electrical connection between the high-voltage input means and the transforming means, said second switch means being located in the power supply means casing to permit external manual operation;

said first and second switch means being disposed in front of said printing mechanism unit and extending through said main cover and said power supply means casing, respectively;

said main cover and said power supply means casing having their respective upper surfaces at substantially the same height;

whereby the respective outer peripheral surfaces of the main body casing and the power supply means casing are flush and continuous with each other, forming substantially rectangular outline of the printer.

2. The printer according to claim 1, wherein said frontwardly extending portion of the main body casing has a corner and includes a notch defined at the front corner, and said power supply means is disposed in the notch.

3. The printer according to claim 2, wherein said power supply means casing is in the form of a rectangular box, said main frame includes a pair of side walls extending at right angles to each other to define the notch, and said power supply means casing is detachably mounted on the main frame through a groove-and-projection arrangement including vertical grooves and projections formed between said side walls and the outer lateral faces of the power supply means casing corresponding thereto.

4. The printer according to claim 1, wherein said main cover is removably mounted on the frontwardly extending portion of the main body casing and hangs over the same so that the control unit can be externally accessed from above the main frame when the main cover is removed.

5. The printer according to claim 4, wherein said printing mechanism unit further includes a subframe directly carrying the platen and the carriage thereon, and a platelike support member directly carrying the platen drive means and the carriage drive means and mounted on the subframe, said platen drive means and the carriage drive means including motors respectively.

6. The printer according to claim 5, wherein said main frame and said subframe are each integrally formed from synthetic rubber, said platelike support member is formed from metal, a metallic contact member is supported on the platelike support member so as to be in contact with the platen for electrical conduction, and grounding means is provided for grounding the platelike support member, said grounding means including a connector which is provided with an earth terminal and is connected to the power supply means and electrically connecting members for releasably connecting said earth terminal to the platelike support member, said connecting members being disposed between the power supply means casing and the main body casing, so that static electricity produced between the platen and the printing sheet is grounded through the contact member, the platelike support member and the grounding means when the power supply means casing is attached to the main body casing.

7. The printer according to claim 6, wherein said grounding means further includes a metallic support plate attached to the control unit, said electrically connecting members include a first conductor sheet electrically connecting the support plate and the platelike support member and a second conductor sheet which is electrically connected to the earth terminal of the connector and is disposed in the power supply means casing, said first and second conductor sheets being electrically connected to each other when the power supply means casing is attached to the main body casing.

8. The printer according to claim 4, wherein said printing mechanism unit is mounted on the top side of the rearwardly extending portion of the main body casing, said control unit is mounted on the bottom side of the main frame, and said main frame has a bottom portion in which an opening is formed so that the control unit can be externally accessed through the opening.

9. The printer according to claim 1, wherein said power supply means casing includes a box which contains the power supply means therein and is disposed side by side with the main frame, and a power supply means cover which is removably mounted on the box and is disposed side by side with the main cover.

* * * * *